US005249523A

United States Patent [19]

Kanzler et al.

[11] Patent Number: 5,249,523

[45] Date of Patent: Oct. 5, 1993

[54] INKING MECHANISM FOR A PRINTING MACHINE

[75] Inventors: Stephan Kanzler, Rodgau; Willi Herbert, Offenbach am Main, both of Fed. Rep. of Germany

[73] Assignee: MAN Roland Druckmaschinen AG, Fed. Rep. of Germany

[21] Appl. No.: 986,588

[22] Filed: Dec. 7, 1992

[30] Foreign Application Priority Data

Dec. 5, 1991 [DE] Fed. Rep. of Germany ..... 4140048

[51] Int. Cl.[5] ..... B41F 31/00

[52] U.S. Cl. ..... 101/350; 101/216; 101/352

[58] Field of Search ..... 101/348, 349, 350, 351-352, 101/216, 219, 309, 311, 329

[56] References Cited

U.S. PATENT DOCUMENTS

| | | | |
|---|---|---|---|
| 3,709,048 | 1/1973 | Stepanek et al. | 101/352 |
| 3,715,979 | 2/1973 | Erb et al. | 101/352 |
| 3,908,545 | 9/1975 | Simeth . | |
| 4,397,236 | 8/1983 | Greiner et al. | 101/350 |
| 4,440,081 | 4/1984 | Betsel | 101/350 |
| 5,065,676 | 11/1991 | Hardin | 101/349 |
| 5,134,939 | 8/1992 | Borne | 101/349 |
| 5,158,019 | 10/1992 | Miescher et al. | 101/349 |

FOREIGN PATENT DOCUMENTS

| | | |
|---|---|---|
| 0000329A1 | 1/1979 | European Pat. Off. . |
| 1761389 | 6/1971 | Fed. Rep. of Germany . |
| 113718 | 6/1975 | Fed. Rep. of Germany . |
| 3034644A1 | 4/1982 | Fed. Rep. of Germany . |
| 3424721C2 | 12/1986 | Fed. Rep. of Germany . |

OTHER PUBLICATIONS

"Technologie des Offsetdruckes" (Technology of Offset Printing), VEB Fachbucherverlag Leipzin 1989, p. 223 ff.

*Primary Examiner*—Eugene H. Eickholt

*Attorney, Agent, or Firm*—Leydig, Voit & Mayer

[57] ABSTRACT

An inking mechanism for a rotary offset printing machine in which ink is taken from an ink reservoir in metered quantities and distributed by inking rollers to form an ink film which is adapted to be applied to a printing plate mounted on a plate cylinder, at least one of said inking rollers being a distributing roller mounted for rotational and axial reciprocating displacement. A distributing drive is provided which includes a releasable shift coupling operable for interrupting axial movement of the distributing roller upon a printing stoppage even though the printing machine continues to operate. Upon resumption of printing, the shift coupling is actuatable by a releasing mechanism so that the distributing rollers resume axial reciprocating movement. The illustrated shift coupling is shown as a pair of gear plates arranged between two drive wheels, and alternatively, a friction closure coupling can be used, either of which can be electromagnetically, pneumatically, or hydraulically actuated.

10 Claims, 2 Drawing Sheets

INKING MECHANISM FOR A PRINTING MACHINE

FIELD OF THE INVENTION

The present invention relates generally to inking mechanisms for printing machines, and more particularly to inking mechanisms for offset printing presses in which ink is taken from an ink reservoir in metered quantities and distributed by inking rollers to a printing plate, at least some of the rollers being distributing rollers adapted for axial displacement during the printing operation.

BACKGROUND OF THE INVENTION

In offset printing machines, ink is dispensed from an ink reservoir and transferred via a vibrating roller to a plurality of inking applicator rollers onto the printing plate mounted on the printing cylinder. One or more of the ink applicator rollers are ink distributing rollers which are adapted for axial transverse movement during the printing operation.

The drive for the distributing rollers may, for example, be in the form of a gear which transforms rotary movement of a gear wheel connected to the plate cylinder to a crank mechanism which has an adjustable stroke and is adaptable for effecting corresponding reciprocating movement of the distributing roller, such as shown in EP 0 000 329 Al, and DD-PS 113 718. Alternatively, cam drives, such as shown in DE 3 424 721 C2, or gears with tumble disks, may be used to effect reciprocating axial displacement of the distributing roller. The stroke as well as the reversal point of the axial movement is adjustable by such drive mechanisms to correspond with the printing requirements and desired ink densities.

In offset printing machines, in the event of a faulty sheet engagement or other malfunction, the paper inflow into the printing machine must be stopped and the last sheet must be allowed to run through the machine. Simultaneously, the ink applicator rolls must be shut off from the plate cylinder and movement of the vibrator roller interrupted. During such stoppage, the speed of the printing machine automatically can be reduced. During the print-free operation when paper is not being run through the printing machine, however, the inking mechanism, by reason of the large number of splitting processes in the ink flow path, continues to effect a balancing of the ink layer thicknesses in both the printing direction and the transverse direction. After resumption of the printing operation, i.e., after proper paper inflow and the corresponding switching in of the switched off elements, a large number of sheets must be run through the printing machine before the proper layer thickness distribution of the inking rollers can be reestablished to the level prior to the stoppage, resulting in considerable waste.

In order to reduce the amount of spoiled sheets after such stoppage, inking mechanisms are known which have so-called ink stream separation. Ink stream separation means that during the "Print Off" operating mode when the printing press is operating without paper passing through the machine, the ink flow in the inking mechanism is interrupted at certain places where inking rollers are separated from one another. The ink layer thickness balancing then only occurs within a reduced number of inking mechanisms. Such ink stream separation is described, for example, in "Technologie des Offsetdruckes" (Technology of offset printing), VEB Fachbucherverlag Leipzin 1989, page 223 ff. Depending upon where the ink separation occurs, ink layer thickness variations still occurs.

OBJECTS AND SUMMARY OF THE INVENTION

It is an object of the present invention to provide an improved inking mechanism which results in reduced sheet spoilage during a printing stoppage.

Another object is to provide an inking mechanism as characterized above which is relatively simple in construction and reliable in operation.

According to the invention, the inking mechanism has one or more distributing rollers which are axially displaceable and which are driven by a distributing drive which includes a releasable shift coupling, adapted to interrupt lateral movement of the distributing roller during a printing stoppage, leaving the distributing roller remaining standing in a reversal position, even though the printing mechanism continues to run. On restoration of printing, the shift coupling is re-engageable to resume transverse axial movement of the distributing rollers commencing at the proper phase. The releasable shift coupling for the distributing drive can be linked by circuitry directly with a control for the "Print On/Off," or with starting and stopping devices associated with the ink applicator rollers, such as through pneumatic cylinders.

In one embodiment of the invention, the shift coupling is disposed at an input or drive wheel side of the distributing drive and is constructed such that it is re-engageable at a particular rotary position of the printing cylinder. Such shift coupling can be effected through gears that are engageable in a single rotary angular position so as to assure that after stoppage lateral movement of the distributor roller is continued in phase with respect to the printing operation. A releasing or re-triggering mechanism of the shift coupling may be electromagnetically actuated or may be operated by hydraulically-pneumatically actuated means. The latter may be actuated by electrically switchable magnetic valves. Shift couplings employing gear plates are known, for example, from DE 2 854 032 Al, and have been used for coupling feeders to the drive of printing machines.

In order to avoid force peaks during re-engagement of the shift coupling, i.e., on switching in again of the disengaged distributing drive, the shift coupling can additionally have a pre-synchronism such that a clutching action occurs, carrying along one coupling part by the other through frictional control for a period prior to complete closed or snapped-in engagement. The time points for actuation of the triggering arrangement can be timed to occur at points of movement of the drive in which the lowest force moments prevail.

In an inking mechanism according to the present invention, in the event of a stoppage in printing, lateral ink distribution can be immediately interrupted. The ink layer thickness profile present on the inking mechanism rollers transversely of the printing direction is not distributed further during the stoppage, and hence, the ink layer thickness profile transversely to the printing direction remains preserved substantially longer than heretofore possible. While the present invention provides advantages over inking mechanisms with so-called ink stream separation, it will be appreciated that the inking mechanism of the present invention may be used with or without such ink stream separation.

Other objects and advantages of the invention will become apparent upon reading the following detailed description and upon reference to the drawings, in which:

Figure 1:
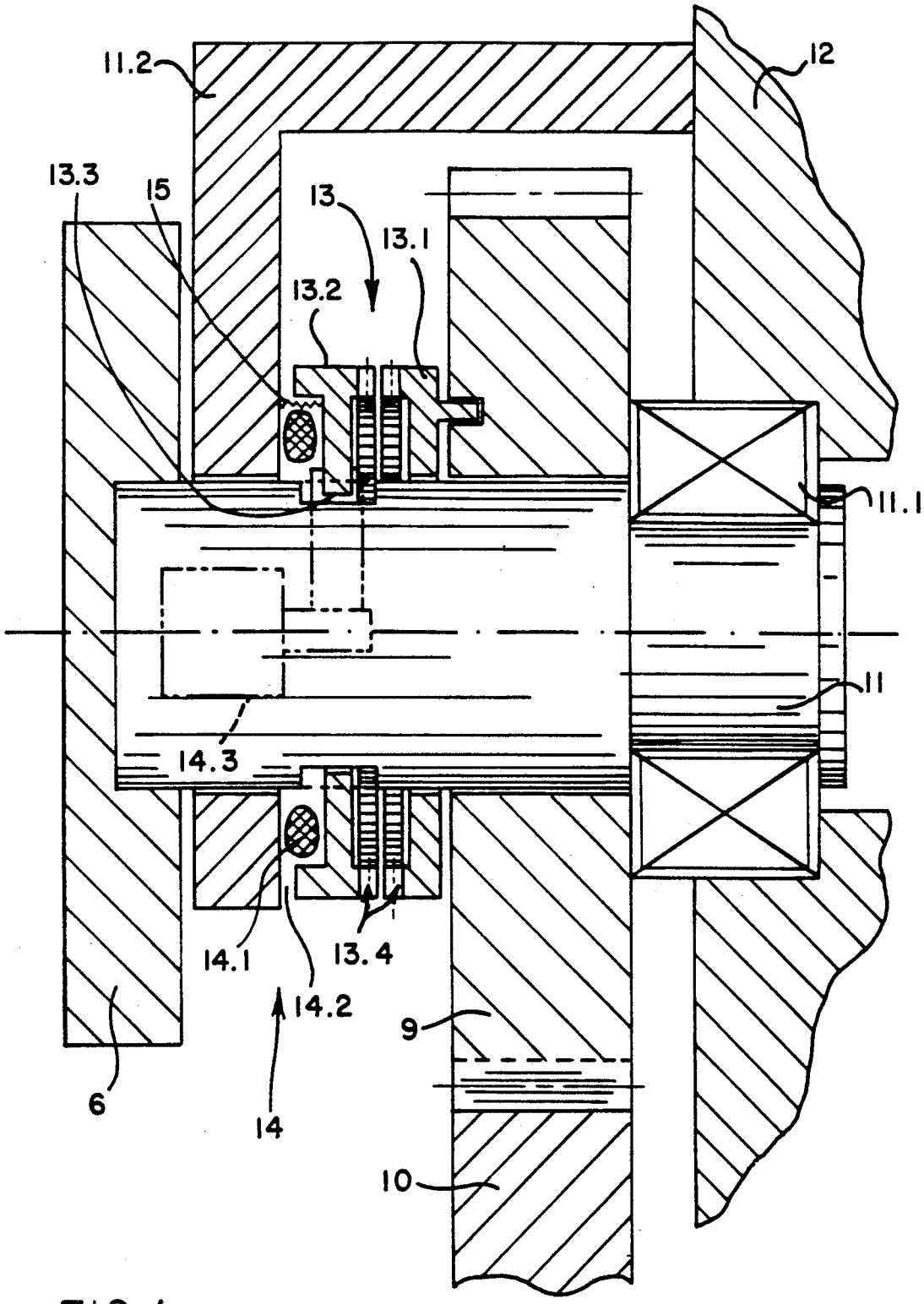
FIG. 1 is a fragmentary section showing a shift coupling for a distributing roller drive of an ink mechanism according to the invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENTS

Referring now more particularly to the drawings, there is shown an illustrative distributing roller drive which may be used in an inking mechanism for a rotary offset printing press in accordance with the invention. It will be understood by one skilled in the art that such inking mechanisms may comprise an ink reservoir, a metering roller, and a plurality of ink applicator rollers, at least some of which are distributing rollers adapted for axially reciprocating movement. For purposes of illustration, a single distributing roller 1 and drive is illustrated.

Figure 2:
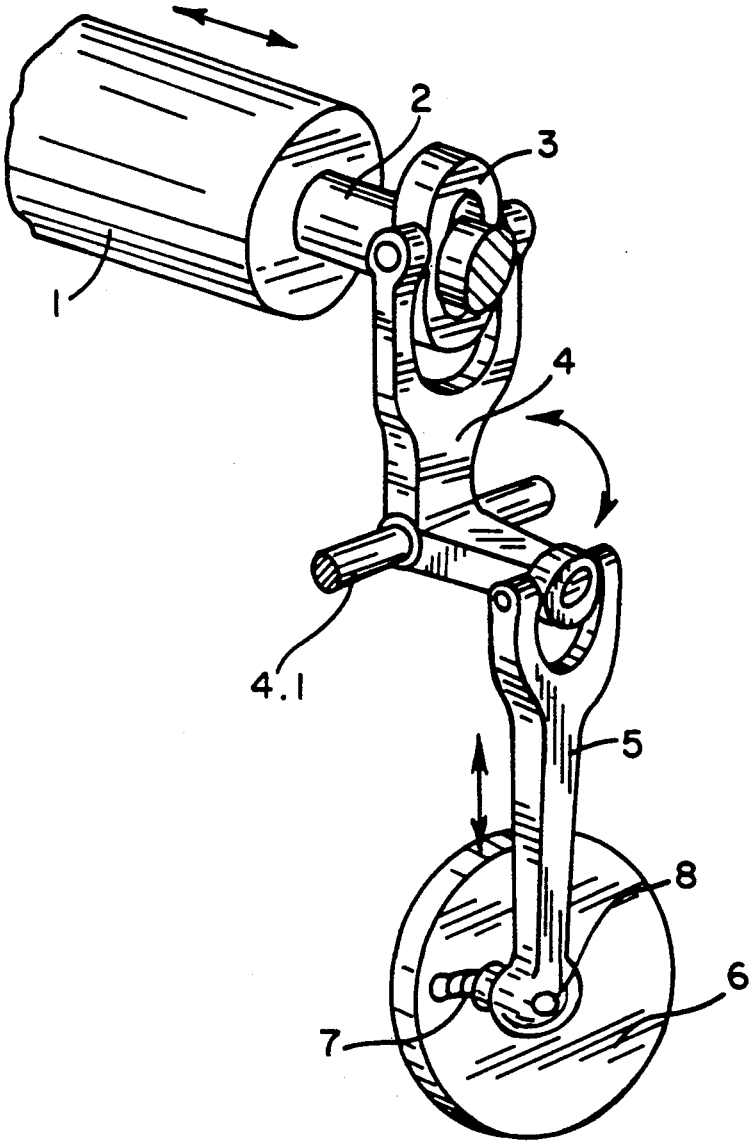
FIG. 2 is an illustrative mechanism for axially displacing the distributing roller in the illustrated drive.

The distributor roller 1 in this case has a trunion 29 that is journaled for rotation and axial movement in a suitable bearing (not shown) supported on the machine frame. As shown in FIG. 2, a transfer ring 3 having an elongated opening engages a corresponding annular groove on the trunion 2. An L-shaped lever 4 has its upper end pivotally connected to the ring 3 and central portion pivotally supported on a shaft 4.1 affixed to the press frame perpendicular to the distributor roller. On a second right angle arm of the lever 4 a rod 5 is pivotally mounted, such as by means of a forked end. The other end of the rod 5 is pivotally connected to a crank wheel 6 of the distributing drive. In order to adjust the stroke of axial reciprocation of the distribution roller 1, the crank wheel 6 has a slot 7 in the radial direction, in which the end of the rod 5 is slidably positionable, upon loosening of an arresting screw 8. It will be understood that the illustrated drive could be adapted for driving several distribution rollers 1 through appropriate connecting mechanisms.

For driving the crank wheel 6 in timed relation to operation of the printing press, as depicted in FIG. 1, the crank wheel 6 may be coaxially connected to a drive wheel 9 which meshes, for example, with a gear wheel 10 mounted on the plate cylinder (not shown). To permit selective adjustment of not only the stroke, but also the point of reversal of reciprocating movement of the distributing roller 1, the drive wheel 9 can be mounted in selected rotational relation with respect to the crank wheel 6, for example by loosening of appropriate mounting screws so that the rotational position of the crank wheel 6 can be varied and selected set with respect to the rotational position of the drive wheel 9, and hence, the plate cylinder.

The crank wheel 6 and drive wheel 9 in this instance are mounted on a common shaft 11 which is supported in a bearing 11.1 disposed in the wall of a side stand 12 of the printing press, as shown in FIG. 1. The crank wheel 6 is affixed to the free end of the shaft 11, after appropriate angular positioning as indicated above, and the drive wheel 9 is supported on the shaft 11 for relative rotational movement. A cover 11.2 affixed to the side stand 12 encloses the drive wheel 9, while permitting free rotation of the shaft 11.

In accordance with the invention, the distributing roller drive includes a shift coupling disposed between the drive wheel 9 and crank wheel 6 for interrupting the axial reciprocating movement of the distributing roller during a printing stoppage, even though the printing machine may continue to operate. To this end, a shift coupling 13 is disposed within the casing 11.2 in interposed relation between the drive wheel 9 and the crank wheel 6. The shift coupling 13 in this case comprises a pair of gear plates 13.1, 13.2, such as known in DE 2 854 032 Al, with one gear plate 13.1 being affixed to the drive wheel 9 and the other gear plate 13.2 being supported on a multiple groove profile 13.3 of the shaft 11 for rotation of movement with the shaft 11 and relative axial shifting movement.

The gear plates 13.1, 13.2 each have an L-shaped profile with a face side formed with a gearing distributed asymmetrically over the circumference in a manner such that mutual engagement of the gears is possible only in a single angular position. The gear plates 13.1, 13.2 are forced together by a biasing spring 15 which urges the gear plate 13.2 axially along the shaft 11 into engaged relation with the gear plate 13.1. When the gear plates 13.1, 13.2 are in such engaged relation, it will be seen that rotational movement of the gear wheel 10, simultaneously with the plate cylinder, drives the drive wheel 9, which in turn rotatably drives the gear plates 13.1, 13.2, the shaft 11, and the crank wheel 6. Rotation of the crank wheel in turn axially reciprocates the distributing roller 1.

In keeping with the invention, to selectively interrupt the axial reciprocating movement of the distributing roller 1, such as during a printing stoppage while the printing machine continues to operate, the drive for the distributing roller 1 includes releasing means 14 for moving the gear plate 13.2 axially on the shaft 11 into disengaged relation from the gear plate 13.1. The releasing means 14 in this instance is in the form of a coil 14.1 mounted on the cover 11.2 in coaxial relation to the shaft 11. The coil 14.1 may be selectively energized to generate a magnetic field which moves the gear plate 13.2 to a position which decreases an air gap 14.2 between the cover 11.2 and the gear plate 13.2 against the force of the biasing spring 15, which causes disengagement of the gear plate 13.2 from the gear plate 13.1.

Alternatively, instead of the coil 14.1, the releasing means make take other forms, such as a hydraulic or pneumatic actuated cylinder 14.3 arranged in the shaft 11 and operatively coupled to the gear plate 13.2, as depicted in phantom in FIG. 1. Actuation of the cylinder can be effected to shift the gear plate 13.2 toward the disengaging position.

As still a further alternative, instead of the shift coupling 13 in the form of gear plates, a friction coupling could be used in conjunction with the releasing means 14. The friction coupling could be engaged at predetermined angular positions of the drive wheel and crank wheel corresponding to points taken from a rotary angular sensor mounted on a revolving shaft of the printing machine, in conjunction with a computer having the stored desired angular position for such engagement. The releasing means 14 could be controlled by appropriate magnetic valves. The frictional properties of the shiftable coupling parts could be dimensioned in such way that there is only negligible slipping during the shifting process.

What is claimed is:

1. An inking mechanism for a rotary offset printing machine in which ink is taken from an ink reservoir in metered quantities and distributed by inking rollers to form an ink film which is adapted to be applied to a printing plate mounted on a plate cylinder, at least one of said inking rollers being a distributing roller mounted for rotational and axial reciprocating displacement, characterized by a distributing drive for rotating said distributing roller and reciprocating the distributing roller axially periodically in timed relation to operation of the printing machine, said drive including a releasable shift coupling operable for interrupting axial movement of said distributing roller upon printing stoppage while said printing machine continues to operate.

2. The inking mechanism of claim 1 in which said shift coupling is electrically actuatable.

3. The inking mechanism of claim 1 in which said drive includes a crank wheel and a drive wheel, said drive wheel being rotated in timed relation to operation of said printing press, said drive wheel having a first coupling member and said crank wheel having a second coupling member, means for effecting reciprocating movement of said distributing roller in response to rotational movement of said crank wheel, and said first and second coupling members being selectively engageable whereby said crank wheel is rotated simultaneously with said drive wheel.

4. The inking mechanism of claim 3 in which said first and second coupling members are engageable only when said drive and crank wheel are in predetermined angular relation to each other.

5. The inking mechanism of claim 3 in which said first and second coupling members are gear plates.

6. The inking mechanism of claim 3 in which said crank wheel and drive wheel are mounted on a common rotatable shaft driven by said printing machine, said drive wheel being mounted on said shaft for relative rotational movement, and said crank wheel being mounted on said shaft for rotation therewith and for axial shifting movement with respect thereto.

7. The inking mechanism of claim 5 in which said gear plates each have opposing faces formed with a gearing, means biasing said one of said gear plates into engaging relation with the other, means for moving one of said gear plates against said biasing means to disengage said gear plates, and releasing means for selectively deactuating said moving means.

8. The inking mechanism of claim 3 in which said shift coupling is a frictional closure coupling between said crank wheel and drive wheel, means for disengaging said closure coupling, and releasing means for reengaging said closure coupling.

9. The inking mechanism of claim 8 in which said releasing means is an electromagnetically actuatable coil.

10. The inking mechanism of claim 8 in which said releasing means is a cylinder which is actuated by a pressure medium.

* * * * *